United States Patent [19]

Nichols

[11] 4,232,358

[45] Nov. 4, 1980

[54] LIGHT FRAME FOR DRAFTING TABLE

[76] Inventor: Webb Nichols, 5 North Square, Boston, Mass. 02113

[21] Appl. No.: 971,746

[22] Filed: Dec. 21, 1978

[51] Int. Cl.[3] ..... G09F 13/04

[52] U.S. Cl. ..... 362/97; 362/223; 362/282; 362/284; 362/307; 362/310

[58] Field of Search ..... 362/97, 223, 307, 310, 362/282, 284

[56] References Cited

U.S. PATENT DOCUMENTS 2,701,838 2/1955 Loesch ..... 362/97

*Primary Examiner*—Stephen J. Lechert, Jr.
*Attorney, Agent, or Firm*—Sandler & Greenblum

[57] ABSTRACT

A light frame for attachment to the underside of a flat surface and a light transmission portion therein includes a light source in the frame, and a mirror pivotally mounted on the frame in alignment with the light transmission portion for reflecting light thereinto. The mirror is pivotal from a closed position, substantially parallel to the top surface, to a deployed position angularly inclined with respect to the top surface. In its closed position, the mirror reflects light from the light source into the light transmission portion thus converting the surface into a light table and permitting a tracing to be made from a master placed on top of the light transmission portion. When the mirror is in its deployed position an image projected into the mirror is reflected onto the back of the light transmission portion permitting a tracing to be made on a mediumm placed on the front surface of the light transmission portion.

13 Claims, 4 Drawing Figures

LIGHT FRAME FOR DRAFTING TABLE

BACKGROUND OF THE INVENTION

This invention relates to a light frame for attachment to the underside of a flat surface and a light transmission portion therein.

Conventional light tables include an open frame having a translucent cover, a light source located beneath the translucent cover, and a bottom closure overlying the projected area of the cover for reflecting light from the source through the cover. When a translucent or transparent medium containing a master drawing is placed on the cover and the light source is illuminated, the lines on the master drawing become visible through a tracing medium placed over the master allowing the subject matter on the master to be traced. The resulting tracing is congruent with the original line drawing on the master. Examples of patents showing conventional light tables described above are the following: U.S. Pat. No. 2,701,838; 2,872,556; 3,122,887; and 4,071,883.

Sometimes it is desired to produce a tracing from an opaque medium, or to produce a drawing whose size is different from the size of the line drawing on a master. In the former case, a conventional light table can be used only if the original master is coverted into a transparency; and in the latter case, the master must be enlarged or reduced photographically before a light table can be used. These procedures are usually not convenient, and it is conventional to use a so-called optical transformation drawing apparatus of the type shown in U.S. Pat. NO. 3,950,085. In this patent, a drafting table is provided with a centrally located light transmission portion; and behind the drafting table is located a mirror which reflects light from an optical projector onto the rear surface of the light transmission portion which acts as a rear-projection screen. A draftsman can then place a tracing medium on the front surface of the light transmission portion and trace the subject matter projected onto the rear surface of such portion. An alternative arrangement for achieving this result is shown in U.S. Pat. No. 2,522,839. The basic problem with the approachs described above lies in the necessity for having two different types of equipment available in a given office, namely a light table and a light projecting apparatus. It would be far more convenient and less costly were it possible to combine these two types of apparatus into a single piece of equipment compatible with a conventional drawing table.

A possible solution to the problem, outside the art relating to drafting tables, is shown in U.S. Pat. No. 2,398,923 which discloses a combination dental diagnosis and office desk in which a light transmission portion is built into the top of the desk. Below such portion is an inclined mirror on which the beam of a slide projector is incident thereby allowing images to be back-projected onto the light transmission portion. Curved extensions of the mirror, where the latter is connected to the underside of the desk, reflect light from linear light sources onto the mirror when it is desired to dispense with the projection and to utilize back lighting. Because the mirror is fixed, and the platform for the projector is attached to the desk in a manner separate from the mirror, the expedient shown in the last identified patent is not suitable for a compact package that can be produced and sold as a separate entity for incorporation into a conventional drafting table.

Therefore, it is an object of the present invention to provide a new and improved light frame for attachment to the underside of a flat surface such as a drafting table such that the frame can convert the surface into a light table or into an optical projecting system by a simple adjustment.

SUMMARY OF THE INVENTION

In accordance with the present invention, there is provided a light frame for attachment to the underside of a flat surface and a light transmission portion therein, the light frame including a light source and a mirror pivotally mounted on the frame in alignment with the light transmission portion for reflecting light thereinto. Means are provided for mounting the mirror for pivotal movement on the frame from a closed to an open position. In the closed position, the mirror is substantially parallel to the top surface of the translucent plate and is effective to reflect light from the light source into the transmission portion. Where the mirror is in such position, the surface can be utilized as a light table for tracing a master placed in the transmission portion.

When the mirror is in its deployed position, it is angularly inclined with respect to the top surface of the light frame. The angle of deployment can be adjusted to change and distort the projected image. In the latter position, the light frame is rigged for projecting images onto the rear surface of the light transmission portion. In such case, a tracing can be made of the image projected on the rear surface of the light transmission portion. To facilitate operation as an optical projection system, the frame includes a platform that preferably is retractably mounted on the frame for deployment from a retracted position within the frame to a deployed position adjacent the free end of the mirror when the latter is in its deployed position. As a consequence, an optical projector mounted on the platform can project an image onto the light transmission portion via reflection from the mirror.

In the preferred construction of the platform, each side of the platform is supported by a pair of telescoping extension arms each having an end pivotably mounted on the frame in slotted tracks that permit both horizontal and vertical adjustment of the platform to be made in order to change the size of the image field displayed on the rear surface of the light transmission portion.

DESCRIPTION OF THE PREFERRED EMBODIMENT

Figure 1:
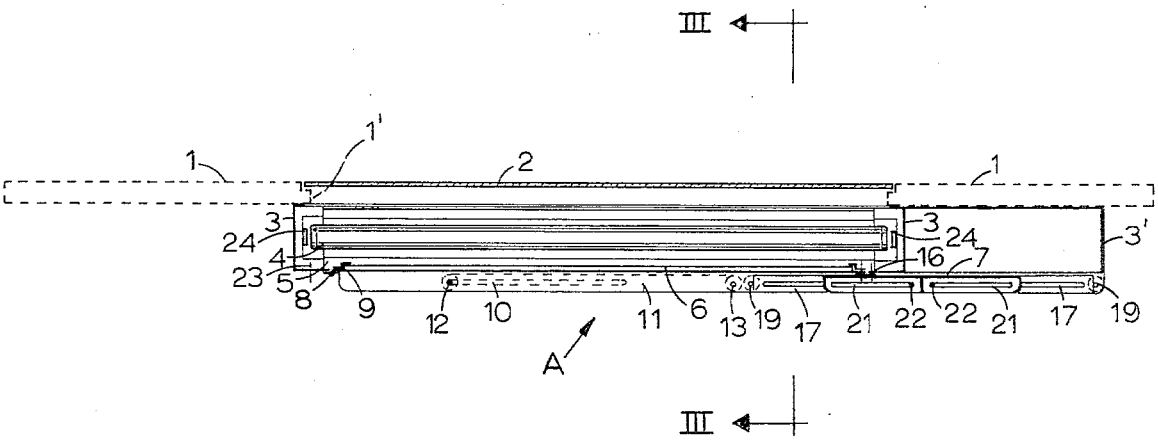
FIG. 1 is a side elevation view of the light frame with the platform in its retracted position and the mirror in its closed position.

Referring now to the drawing, reference character A designates a light frame according to the present invention incorporated into a drafting table whose top surface is indicated by reference numeral 1. Surface 1 is provided with an opening 1' having a peripheral relieved portion for receiving a sheet or plate of translucent material 2 which forms a light transmission portion contiguous with the flat top surface of the drafting table.

Light frame A is attached to the underside of the drafting table as indicated in the drawing. Specifically, light frame A comprises channel-shaped beam members connected together to form a rectangular housing that is open at the top and bottom, and extensions 3' projecting from one of the beam members and spaced apart a distance large enough to receive platform 7 which is, itself, wide enough to accomodate an optical projector (not shown) such as a slide, opaque, video, or movie projector. The channel-shaped nature of the beam members of the light frame permit the light frame to be attached to the underside of a drafting table adjacent the aperture 1' such that plate 2 is flush with surface 1 and forms a continuation thereof.

On opposite arms of the channel-shaped beam members is a linear light source 4 which is mounted on a light housing 24 fitting within the channel-shaped beam members. Housing 24 includes reflector 5 for the purpose of causing the light output from the linear light source to be reflected downwardly away from translucent plate 2 as well as upwardly towards the plate. Finally, the light frame includes mirror 6 mounted in frame 9 that is pivotally mounted on hinge 8 to the channel-shaped beam members of the light frame for pivotable movement from a closed position shown in FIG. 1 to a deployed position shown in FIG. 2. To retain the mirror in its closed position, latch 16 on the free end of the mirror frame 9 is engagable with a suitable keeper (not shown) on one of the channel-shaped beam members. In order to support the mirror 6 at a predetermined angular position with respect to the frame, a pair of arms 11, pivotably mounted at 13 to the light frame, is provided with the free ends of these arms carrying rod 12 whose free ends are slidably engaged in slide track 10 formed in the mirror mounting frame. Adjustment knobs 15 threaded on the free end of rod 12 can be tightened in order to hold the mirror 6 in a plurality of angular positions depending on the location of rod 12 with respect to slot 10.

Figure 2:
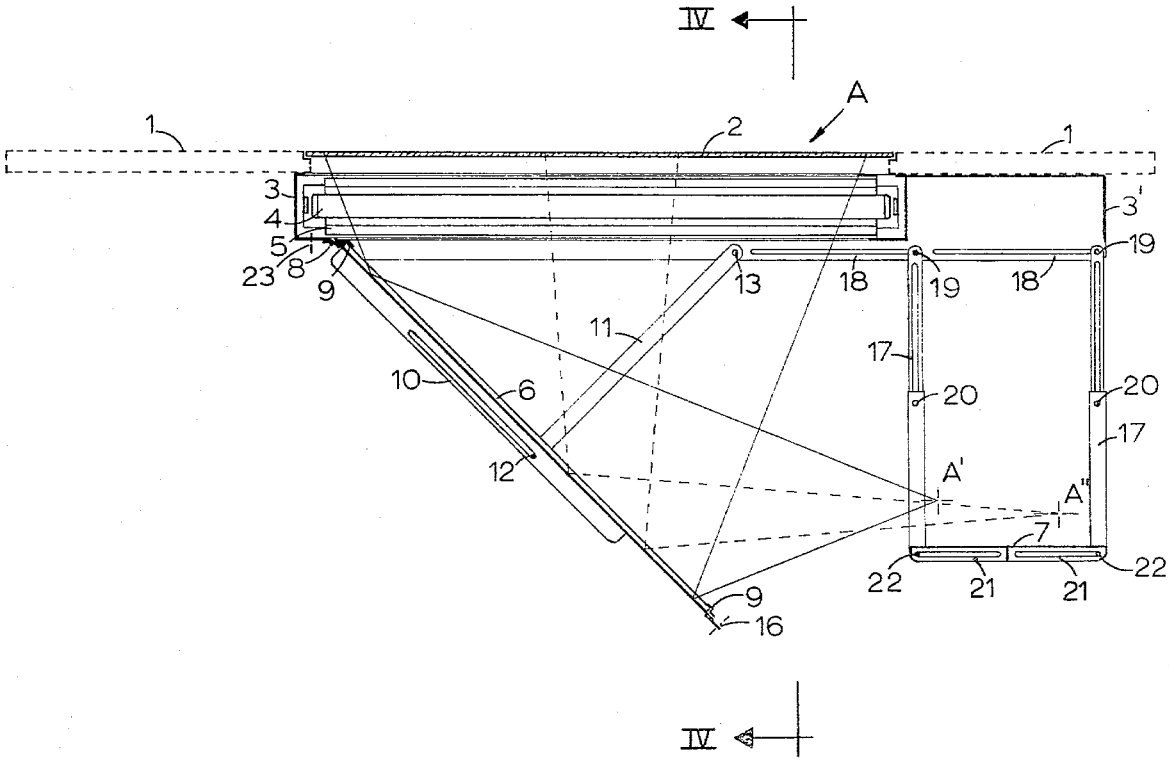
FIG. 2 is view of the light box similar to FIG. 1. but showing both the platform and the mirror in their deployed positions.

Each side of platform 7 is supported from the frame housing 3' by a pair of telescoping extension arms 17. The lower end of each of these telescoping arms is provided with a slide rod that passes through and is slidably engaged in platform tracks 21. Knobs 22 threaded onto the free ends of the slide rod permit the platform to be adjustably mounted on the extension arms. Lock knobs 20 on the lower arms 17 pass through slots in the upper arms 17 and releasably hold the platform at a preselected distance from the light frame housing. The other end of each of the upper extension arms is provided with a rod which is slidably received in separate tracks 18 as shown in FIG. 2. Lock knobs 19 on these slide rods permit the user to select the horizontal position of the platform. As a consequence of tracks 18, and the telescoping nature of extension arms 17, platform 7 can be moved to a preselected horizontal and vertical position relative to mirror 6 when the latter is in its deployed position shown in FIG. 2. An indication of adjustment available to platform 7 is indicated by the projector positions A' and A" shown in FIG. 2.

Figure 3:
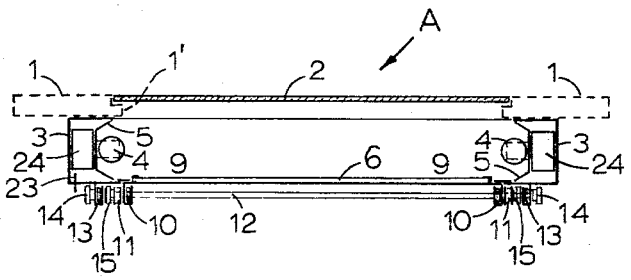
FIG. 3 is a sectional view taken generally along the line III—III of FIG. 1.
Figure 4:
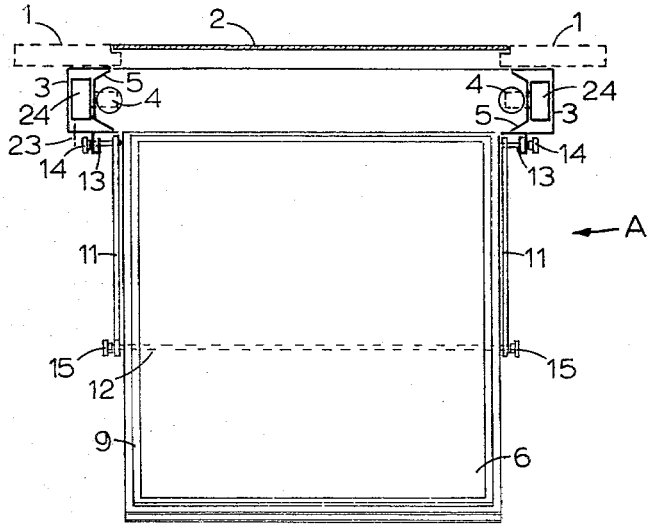
FIG. 4 is a sectional view of the light frame showing the light frame in its deployed position, and taken along the line IV—IV of FIG. 2.

In order to retract platform 7 within the frame housing 3', locking knobs 20 are released thereby allowing the extension arms 17 to telescope one within the other and raising the platform 7 toward frame housing 3'. When lock knobs 19 are loosened, the extension arms can slide until the platform 7 is totally retracted within the frame housing as shown in FIG. 3. When in this position, knobs 19 can be tightened and the frame 7 will be retained in its retracted position.

In operation, the light frame can convert a flat surface such as drafting table into a light table by placing mirror 6 in its closed position as shown in FIG. 1. In such case, actuation of power switch 23 will cause tubes 4 to be illuminated and light therefrom will be reflected by mirror 6 upwardly through plate 2 allowing the user to place a translucent or transparent medium carrying a master drawing on the top surface of sheet 2 in preparation for tracing of the image thereon. It is useful, in this mode of operation for the power switch 23 to be serially connected to a switch associated with and closed by latch 16 when it retains the mirror in its closed position such that tubes 4 can be illuminated only when both of the switches are closed, i.e., when the mirror is in its closed position. Optionally, this interlock can be overridden to permit operation of the power switch in order to illuminate plate 2 while the projector is in operation in order to permit viewing subject matter drawn.

When it is desired to utilize plate 2 as a rear projection screen, and when it is desired to use an optical projector for producing an image on the rear surface of the plate 2, locking knobs 19 can be released thereby permitting platform 7 to be deployed from its retracted position to its extended position as shown in FIG. 2. A projector can then be mounted on the platform and focused to produce an image on the rear surface of plate 2. In this case, the user can place a transparent medium over plate 2 for the purpose of tracing the image projected on the rear surface thereof.

As indicated above, platform 7 has both vertical and horizontal adjustment for control of the placement and size of the projected image on sheet 2. Vertical adjustment is controlled and fixed by the cooperation between extension arm 17 and the locking knobs 20. Horizontal adjustment is controlled and fixed by the cooperation between knobs pins 1 and slide tracks 18. The projection platform is configured to support slide, opaque, video or movie projectors for the purpose of providing multimedia utilization.

It is believed that the advantages and improved results furnished by the method and apparatus of the present invention are apparent from the foregoing description of the preferred embodiment of the invention. Various changes and modifications may be made without departing from the spirit and scope of the invention as described in the claims that follow.

What is claimed is:

1. A light frame for attachment to the underside of equipment having a flat top surface which has a light transmission portion, said frame comprising:

(a) a housing having an opening at the top for alignment with the light transmission portion;

(b) light source means attached to the housing;

(c) a mirror attached to the housing for reflecting light from the source through the opening in the housing;

(d) means mounting the mirror for pivotal movement on the housing from a closed position for reflecting light from the light source through the opening in the housing, to a deployed position angularly inclined with respect to the top surface for projection and control of the shape of the images projected through the opening.

2. A light frame according to claim 1 including a platform retractably mounted on the frame for deployment from a retracted position to a deployed position adjacent the free end of the mirror when the latter is in its deployed position, the platform being adapted to hold an optical projector which projects an image through the opening in the housing via reflection from the mirror.

3. A light frame according to claim 2 wherein each side of the retractable platform is supported by a pair of extension arms each having one end pivotably mounted on the frame in slotted tracks that effect displacement of the platform in a position such that the platform remains substantially parallel to the plane of the top surface and the plane of the mirror when the latter is in its closed position.

4. A light frame according to claim 3 wherein each extension arm includes a pair of telescopic members.

5. A light frame according to claim 1 including a power switch for selectively illuminating the light source means when the mirror is in its closed position whereupon the light source can be used for tracing purposes.

6. A light frame according to claim 5 including an auxiliary switch serially connected to the power switch and closed in response to movement of the mirror to its closed position.

7. A method for using the light frame of claim 1 including the steps of:

(a) placing a tracing medium over the opening in the housing;

(b) projecting an image onto the mirror when the latter is in its deployed position for back projecting said image onto the tracing medium; and (c) selectively turning-on said light source means while said image is being back-projected in order to obscure said image for facilitating inspection of the subject matter on said medium.

8. The combination of a light frame with a device having a flat top surface with a light transmission portion therein, the combination comprising:

(a) a housing having an opening at the top and attached to the underside of the device so that the opening is aligned with the light transmission portion of the device;

(b) light source means attached to the housing;

(c) a mirror attached to the housing and aligned with the light transmission portion for reflecting light thereinto; and (d) means mounting the mirror for pivotal movement on the housing from a closed position substantially parallel to the top surface for reflecting light from the light source into the transmission portion, to a deployed position angularly inclined with respect to the top surface.

9. The combination of claim 8 including a platform retractably mounted on the frame for deployment from a retracted position to a deployed position adjacent the free end of the mirror when the latter is in its deployed position, the platform being adapted to hold an optical projector which projects an image into the rear surface of the light transmission portion via reflection from the mirror.

10. The combination of claim 9 wherein each side of the platform is supported by a pair of extension arms each having one end pivotably mounted on the frame in slotted tracks that effect displacement of the platform in a position such that the platform remains substantially parallel to the top surface.

11. The combination of claim 10 wherein each extension arm includes a pair of telescopic members.

12. The combination of claim 8 including a power switch for selectively illuminating the light source means when the mirror is in its closed position whereupon the light source can be used for tracing purposes.

13. The combination of claim 12 including an auxiliary switch serially connected to the power switch and closed in response to movement of the mirror to its closed position.

* * * * *